US005798749A

United States Patent [19]

Minematsu et al.

[11] Patent Number: 5,798,749

[45] Date of Patent: Aug. 25, 1998

[54] GRAPHIC DISPLAY CONTROL APPARATUS

[75] Inventors: Isao Minematsu; Koji Hirano; Hiroki Takita, all of Itami, Japan

[73] Assignee: Mitsubishi Denki Kabushiki Kaisha, Tokyo, Japan

[21] Appl. No.: 539,213

[22] Filed: Oct. 4, 1995

[30] Foreign Application Priority Data

May 11, 1995 [JP] Japan ..... 7-113294

[51] Int. Cl.[6] ..... G09G 5/34

[52] U.S. Cl. ..... 345/123; 345/121

[58] Field of Search ..... 345/116, 121–123, 345/189, 190, 124, 125, 112, 341, 157, 159, 56

[56] References Cited

U.S. PATENT DOCUMENTS

| | | | |
|---|---|---|---|
| 4,491,834 | 1/1985 | Oguchi | 345/123 |
| 4,549,173 | 10/1985 | Nakamura | 345/123 |
| 4,849,746 | 7/1989 | Dubner | 345/124 |
| 5,177,624 | 1/1993 | Sato | 345/123 |

*Primary Examiner*—Regina Liang

*Attorney, Agent, or Firm*—McDermott, Will & Emery

[57] ABSTRACT

A graphic display control apparatus which automatically scrolls display contents of a screen vertically, horizontally or diagonally by automatically updating the reading address corresponding to the amount of scrolling, when read-out areas for display information of one screen read out from a frame memory whose capacity allows a CPU to write display information larger than one screen, e.g., an animation background, a motorcar navigation map or the like therein are sequentially moved, thereby to lighten the burden of the CPU at the scrolling time.

28 Claims, 12 Drawing Sheets

BEFORE SCROLLING

AFTER SCROLLING

GRAPHIC DISPLAY CONTROL APPARATUS

BACKGROUND OF THE INVENTION

1. Field of the Invention

The present invention relates to a graphic display control apparatus which scrolls images on a screen by successively shifting read-out areas of display information corresponding to one screen from a frame memory whose capacity of display information is larger than one screen, e.g., a background of animation and a motorcar navigation map, etc.

2. Description of the Related Art

In a computer system equipped with a display unit such as a CRT (cathode ray tube) display or a liquid crystal display, display information of each pixel constituting the image is first temporarily written in a frame memory, and a graphic display control apparatus (hereinafter "GDC apparatus") continuously transfers the display information of each pixel to the display unit thereby to display the image.

FIG. 1 is a diagrammatic picture showing the transfer order of display information read out from a frame memory whose capacity is larger than one screen. By automatically updating addresses which has been set by a CPU (central processing unit) for reading out from the frame memory, the GDC apparatus transfers the display information of each pixel from the upper left end of the screen to the right along one scanning line as shown by arrows. When it reaches the right end, the transfer is resumed from the left end of the next scanning line. The same procedure is conducted along each scanning line from top to bottom. If the display unit is, for example, a CRT, display information is not transferred neither while beams are moved from the right end of the screen in one scanning line to the left end of the next scanning line, nor while beams are moved from the lower right end of the precedent screen to the upper left end of the next screen (vertical interval).

In a computer system which functions to continuously display images which is larger than one screen, e.g., an animation background, a motorcar navigation map through scrolling, display information of the whole images which is larger than one screen is preliminarily written in the frame memory, and a read-out area for the display information of one screen is shifted every small amount, for instance, pixel by pixel so as to gradually scroll the display content of the screen without giving any visually unnatural feeling to the user.

FIG. 2 is a conceptional diagram showing the relationship at the scrolling time, between the frame memory where display information of an image indicated by a hatched circle is written and a display area from which display information of one screen is read out. By shifting the display area shown in FIG. 2A to a position on the frame memory shown in FIG. 2B, the image on the screen is scrolled to the left.

Another case will be described in which a continuous image far beyond a range of the frame memory whose a capacity is larger than one screen is scrolled. FIG. 3 is a conceptional diagram showing the relationship between the data-stored area (area actually storing display information) of the frame memory and the display area from which display information of one screen is read out. The display area is shifted to the right as indicated by an arrow shown in FIG. 3A. Just before the right end of the display area reaches that of the data-stored area as shown in FIG. 3B, the display content of the right half part of the data-stored area including the display area is copied into the left half part of the data-stored area as shown in FIG. 3C. Then display information of an image to be displayed through scrolling in succession to the currently displayed image is written in the right half part of the data-stored area. When display area is moved to a position shown in FIG. 3C as a result of copying, the display content continues to move in the right direction. In this way the image newly written in the right half part of the data-stored area is displayed through scrolling without a break.

The conventional GDC apparatus automatically generates a reading address by adding a prescribed value and an address of a representative point, generally the top left corner, of the display area stored in a register which is set by the CPU as an initial value. This adding operation is executed synchronously with consecutive transfers of display information about each pixel to the display unit. In this case, such a problem as follows is likely to occur. Before the GDC apparatus finishes the transfer of display information of one screen, that is, before an address to be transferred reaches the vertical interval within a transferring cycle, if the CPU changes the initial value in the register into that for the next display area, display information is transferred from the address which is added the prescribed value to the updated initial value. This display information of a figure is for the next screen, thereby resulting in a displacement of the figure on the screen. In order to prevent this problem, the CPU must monitor the state of the GDC apparatus, and, in addition, the CPU must repeatedly make sure throughout scrolling that the transfer of display information by the GDC apparatus is within the vertical interval when it changes the initial value of the reading address stored in the register. As a result, the CPU may be overloaded at the scrolling time.

In a case where the capacity of the frame memory is larger than data of one screen and an image is larger than the capacity of the frame memory, a further overload is imposed upon the CPU through scrolling with a conventional GDC apparatus, because the CPU should set aside an area in the frame memory by copying the information being displayed into another area just before the display area reaches the boundary of the data-stored area, that is, before no display information is available to be read from the frame memory, so as to write the image information which is displayed subsequently. This requires the CPU to periodically compare the locations of display areas with the boundary of the data-stored area, imposing a lot of burden to the CPU at the scrolling time.

SUMMARY OF THE INVENTION

The present invention is directed to solve the problems pointed out above, and it is a principal object of the invention to provide a GDC apparatus in which once a CPU sets values related to scrolling, e.g., the amount of one scroll, the number of scrolls to be executed and the like, the scrolling is automatically repeated a preset number of times, thereby reducing the load of the CPU at the scrolling time.

A GDC apparatus of the invention preferably includes an address storing means for storing a reading address specifying a read-out area when scrolling is started, a scroll amount storing means for storing the amount of one scroll, a scroll times storing means for storing the number of scrolls, an operation unit for updating the reading address stored in the address storing means according to the amount of one scroll stored in the scroll amount storing means, an address generating means for generating a reading address of a frame memory to read out display information according to the reading address stored in the address storing means, a counting means for counting the number of executed scrolls, thereby automatically repeating a scroll of a display content on a screen horizontally, vertically or diagonally in accordance with the stored amount of one scrolling.

A GDC apparatus of the invention preferably enables the storing of the number of pixels from the original position to the target position of the scroll of a display content, the X- and Y-coordinates values representing the location on the screen, and an address value on the frame memory, all of which indicate a distance from a prescribed position of the original read-out area to a prescribed position of a target read-out area to specify the amount of one scrolling.

In a GDC apparatus of the invention, an interrupt signal generating means is preferably provided to generate an interrupt to the CPU when a prescribed number of scrolls are finished.

In a GDC apparatus of the invention, a scroll-frequency storing means is preferably provided for storing a moving frequency of the read-out area for display information to determine a scrolling speed.

A GDC apparatus of the invention preferably equipped with a plurality of amount storing means and/or a plurality of times storing means and/or a plurality of scroll-frequency storing means.

A GDC apparatus of the invention is preferably equipped with means for judging whether the reading address of the read-out area exceeds a memory space of the frame memory specified by the maximum address and the minimum address as a result of scrolling specified by the amount and the number stored in the storing means, and means for notifying an error either in the amount of a scroll stored in the amount storing means or in the number of scrolls stored in the times storing means when it judges that the read-out area exceeds the address space of the frame memory.

In GDC apparatus of the invention is preferably provided with means for judging, based on the reading address for the read-out area during scrolling, whether the read-out area approaches the boundary of the address space of the frame memory in the moving direction of the read-out area, and a generating means for generating an interrupt to the CPU to notify to write display information of the second display content which is displayed through scrolling successively to the first display content being displayed when the read-out area approaches the boundary of the address space of the frame memory in the moving direction.

In a GDC apparatus of the invention is preferably provided with means for interrupting the scroll and with means for outputting information representing the number of executed scrolls or an integrated amount of scrolls up to the interruption.

In the apparatus of the invention, once data related to scrolling such as the amount of one scroll, the number of scrolls to be executed, etc. are stored at the starting time, the reading address specifying the read-out area is updated according to the amount of one scroll every scrolling time. The address of the frame memory from which display information is read out is generated according to the reading address stored in the address storing means for each time of scroll. Accordingly, scrolling is automatically carried out vertically, horizontally or diagonally. The CPU is not required to monitor the address of display information being transferred from the frame memory in search for timing for changing the reading address of the read-out area into the next value. The load of the CPU hence lightens.

In the apparatus of the invention, either the number of pixels from the original position of the display content to the target position, coordinates values from the original position of the display content before scrolling to the target position in XY coordinates, or address values from the position of the original read-out area to the position of the target read-out area may be stored as the amount of one scroll.

In particular, specifying the amount of scroll in XY coordinates values enables the user to directly and intuitively grasp the amount of scroll, thereby providing excellent user interface.

The apparatus of the invention is convenient in that scrolling is interrupted when a desired figure is displayed, thereby providing excellent user interface.

The apparatus of the invention allows a variety of scrolls at any speed determined by the scrolling frequency of the read-out areas.

The apparatus of the invention realizes complicated scrollings by specifying a plurality of the amount of scrolling, and/or a plurality of the number of scrolls and/or a plurality of the scrolling frequencies.

The apparatus of the invention enables the users to estimate, prior to starting to scroll, the result of scroll specified by the amount and the number stored in the respect storing means, thereby to notify an error in the amount or the number when an expected read-out area extends beyond the address space in the frame memory in the course of scrolling. The user easily find the error before starting the scroll, which facility provides excellent user interface.

In the apparatus of the invention, when the second display content is to be displayed successively to the first display content, and when display information about the second display content is not written in the frame memory and that of the first display content is written, an interrupt is generated so as to notify the CPU to write the display information about the second display content in the frame memory at the moment when the location of a read-out area in the course of scrolling reaches a particular point near to the boundary of the frame memory located in the direction in which the read-out area moves. Thus the CPU is unnecessary to monitor the locations of read-out areas, and its load reduced.

The apparatus of the invention outputs information on the number of scrolls or the sum of scrolls executed up to the interrupted time when the scrolling is interrupted. It is thus easy for software which controls the scrolling to know the amount and the number of executed scrolls.

The above and further objects and features of the invention will be more fully apparent from the following detailed description with accompanying drawings:

DETAILED DESCRIPTION OF THE PREFERRED EMBODIMENTS

Embodiment 1

Figure 1:
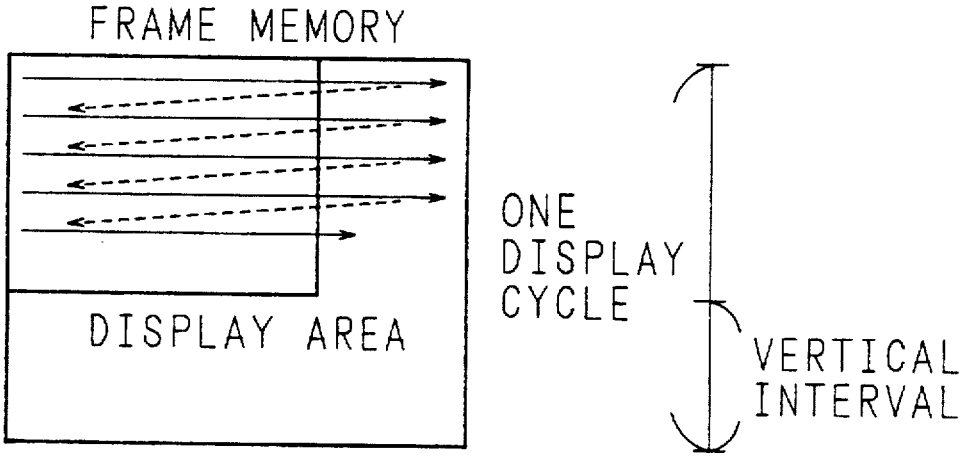
FIG. 1 PRIOR ART
FIG. 1 is a conceptual diagram of the transferring direction of display information from a frame memory.
Figure 2A:
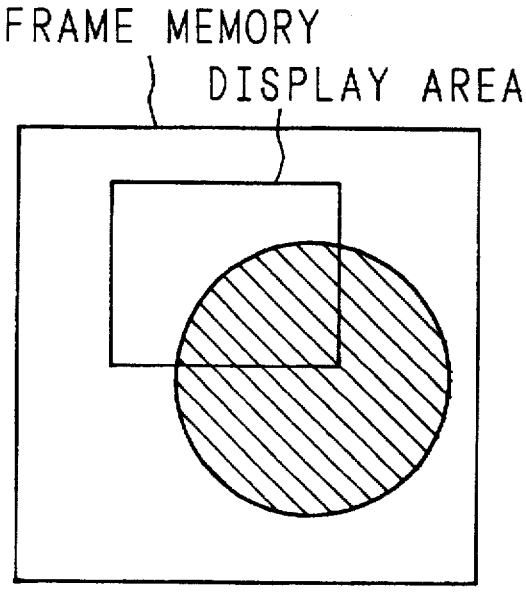
FIG. 2A PRIOR ART
FIGS. 2A and 2B are conceptual diagrams showing the relationship between a figure to be drawn in accordance with display information in the frame memory and a display area of one screen at the time of scrolling.
Figure 2B:
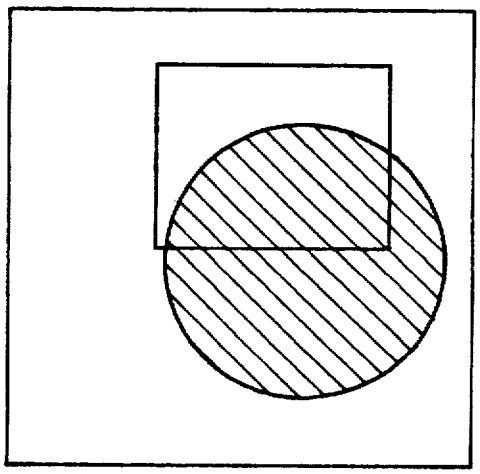
FIG. 2B PRIOR ART
Figure 3A:
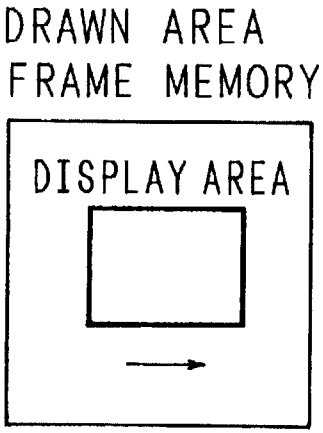
FIG. 3A PRIOR ART
FIGS. 3A, 3B and 3C are conceptual diagrams showing the relationship between the display area and the frame memory at the time of scrolling and rewriting of the display information of the frame memory.
Figure 3B:
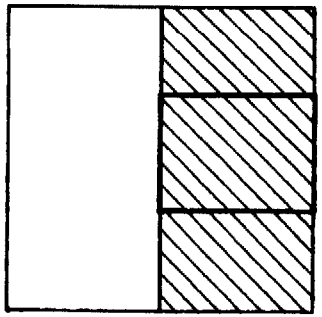
FIG. 3B PRIOR ART
Figure 3C:
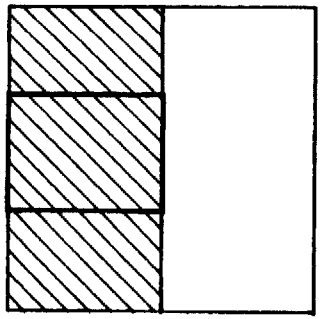
FIG. 3C PRIOR ART
Figure 4:
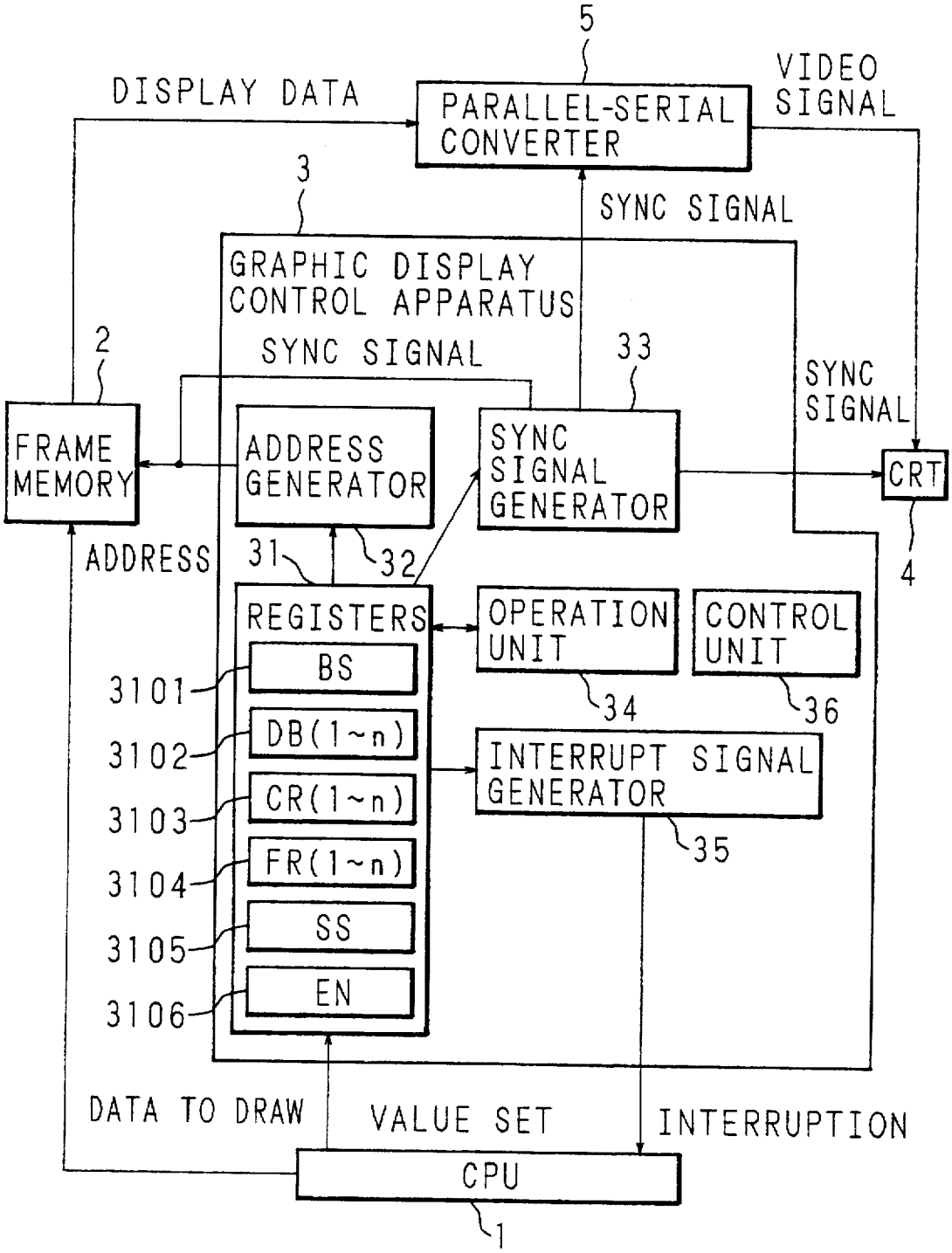
FIG. 4 is a structural block diagram showing a first embodiment of a GDC apparatus embodying the present invention which is incorporated in a computer system.

FIG. 4 is a block diagram showing the configuration of a computer system having a GDC apparatus of the first embodiment incorporated therein. In FIG. 4, a CPU 1 draws a picture in a frame memory 2, and sets data related to scrollings such as the amount and the number of scrolls to be executed once prior to scrollings, and have the GDC apparatus 3 control the scrollings. The GDC apparatus 3 executes the scrollings, according to the values set by the CPU 1. The GDC apparatus 3 outputs display information written in the frame memory 2 to a parallel-serial converter 5 which converts the parallel display information into serial video signals and transfers them to a CRT 4.

The GDC apparatus 3 is constructed as follows. The GDC apparatus 3 is provided with registers 31, which includes a display address register BS3101, a scroll-amount register DB3102, a scroll-times register CR3103, a scroll-frequency register FR3104, a scroll-start register SS3105, and a scroll-end notice register EN3106. The display address register BS3101 stores an address of a display area from which scrolling is started; generally, the address corresponds to display information about a pixel at the upper left corner of the display area of the CRT4. The scroll-amount register DB3102 stores the amount of one scrolling specified either in the number of pixels, coordinates values of the X- and Y-axes, or address values, etc. The scroll-times register CR3103 is constituted of, for example, a down counter which counts down the number of executed scrolls by decrementing one for every scroll. The scroll-frequency register FR3104 stores a moving frequency of scroll to determine a scroll speed. The scroll-start register SS3105 starts the GDC apparatus 3 to scroll, for instance, when a value other than zero is set, and is automatically initialized to zero when the scrolling is finished. The scroll-end notice register EN3106 notices the completion of the scroll to the CPU 1 by generating an interrupt to the CPU 1 when the scroll is normally completed in the case where a value other than zero, for instance, is set. It is possible to provide the GDC apparatus 3 with a width register WR (not shown) which designates the number of pixels per one scanning line of the CRT 4, and a pixel-size register PR (not shown) which designates the number of bits of display information per pixel.

The scroll-amount register DB3102, the scroll-times register CR3103 and the scroll-frequency register FR3104 are respectively provided in "n" sets, so that "n" kinds of values can be set so as to specify intricate "n" kinds of scrolls differing in the amount, frequency and speed of scrolling.

The display address register BS3101 may store additional address data according to the number of bits allotted to display information per pixel. That is, when one pixel is composed of eight bits, address data locating a byte is also stored. When a pixel is composed of four bits, address data with one additional bit indicating whether the four bits are located in most or least significant of eight bits are stored. If a pixel is composed of two bits, address data with two additional bits indicating in which set of two bits the two bits are located in the byte are stored. If a pixel is composed of one bit, address data with three additional bits indicating which bit in the byte is located are stored.

An address generator 32 reads address data stored in the display address register BS3101, and generates a read-out address for reading out display information from the frame memory 2 to be transferred to the CRT 4. A synchronizing signal generator 33 generates synchronizing signals for transferring of the display information from the frame memory 2 to the parallel-serial converter 5 and for transferring of video signals from the parallel-serial converter 5 to the CRT4, etc., with sending those signals to other parts of the apparatus. An operation unit 34 updates the address data in the display address register BS3101 by adding/subtracting a value corresponding to the amount of one scrolling set in the register DB3102 to/from the value in the register BS3101 each time one scrolling is finished. An interrupt signal generator 35 generates an interrupt signal to the CPU 1 when the scrolling of a number set in the register CR3103 are normally finished, etc. A control unit 36 controls the operation of each part in the apparatus.

Figure 5:
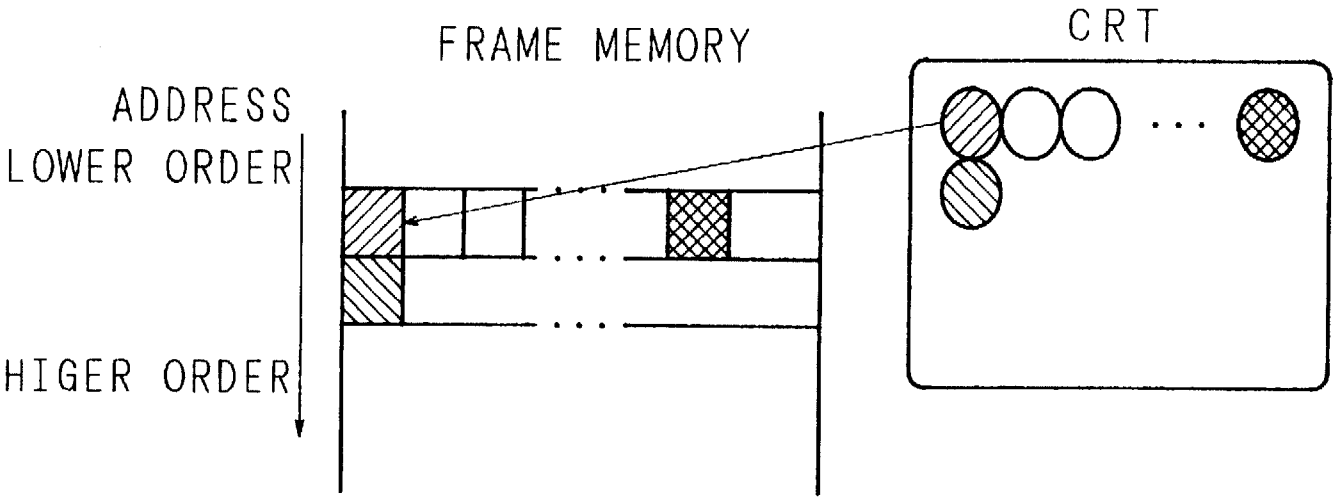
FIG. 5 is a conceptual diagram showing the relationship between storing positions of display information about each pixel in the frame memory and each pixel on a display.

FIG. 5 is a diagram representing the relationship between each pixel on the screen of the CRT4 and a stored position of display information of the pixel in the frame memory 2. The display information of each pixel is stored in an address from the lower address to the upper address in the frame memory 2 corresponding to the position of the pixel on the CRT from the upper left part to the lower right part of the CRT 4.

Figure 6A:
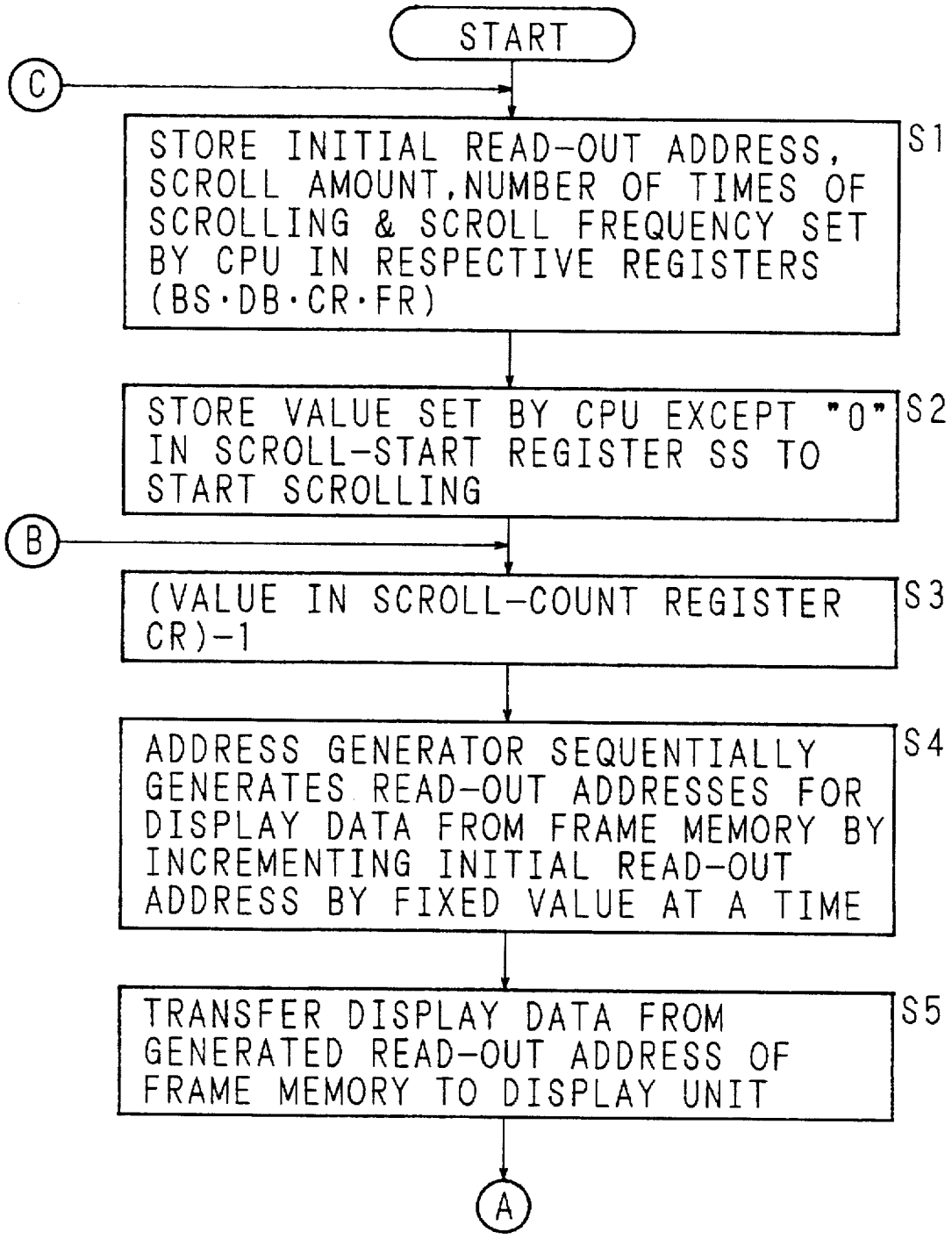
FIGS. 6A and 6B are flowcharts schematically showing steps of scrolling in the GDC apparatus according to the present invention.
Figure 6B:
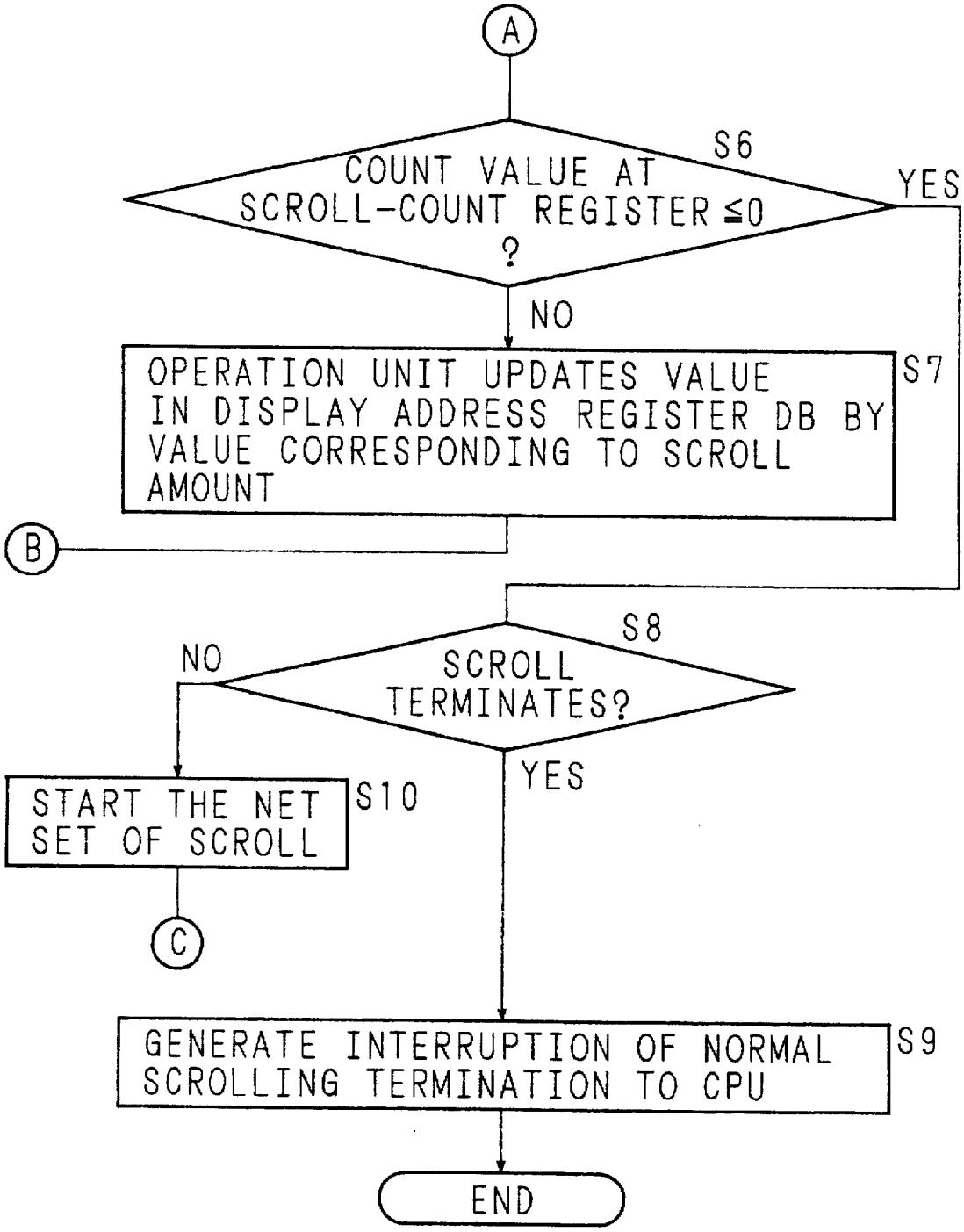

Referring to flowcharts of FIGS. 6A, 6B, the scrolling operation of the GDC apparatus with the structure explained above will be described schematically.

An initial value of the reading address, the amount of scrolling, the number of scrolls to be executed, and the scrolling frequency set by the CPU 1 at the scrolling start, are respectively stored in the display address register BS3101, the scroll-amount register DB3102, the scroll-times register CR3103, and the scroll-frequency register FR3104 (Step S1). Any other value than zero set by the CPU 1 is stored in the scroll-start register SS3105, whereby the scroll is started (Step S2). At commencement of the scroll, one is subtracted from the value stored in the scroll-times register CR3103 (Step S3). The address generator 32 adds the display address register BS3101 and a prescribed value, and generates a read-out address for reading display information from the frame memory 2 (Step S4).

The display information read from the read-out address of the frame memory 2 which is generated by the address generator 32 is transferred to the CRT 4 through the parallel-serial converter 5 (Step S5). When one screen of data is transferred, it is ascertained whether the count value in the scroll-times register CR3103 becomes zero or smaller (Step S6), which means that the scrolling has been conducted the preset number of times. If the preset number of scrolls are not yet finished, the operation unit 34 updates the value of the display address register BS3101 according to the amount of scrolling (S7), so that an initial value of a read-out address for the next screen is stored at the display address register BS3101. Steps S3 to S7 are repeated to scroll the display content until the scrolling is executed the preset number of times. When the preset number of scrolls are finished, the sequence advances to Step S8 to ascertain whether values are respectively set at the 2nd to nth scroll-amount registers DB3102, the 2nd to nth scroll-times registers CR3103, and the 2nd to nth scroll-frequency registers FR3104, in other words, to determine whether the scrolling is to be executed under other respective preset values. If the preset number of scrolls are not completed, in order to start the net set of scroll (S10), the sequence returns to Step 1 and Steps S1 to S7 are repeated according to the values set at the 2nd to nth sets of registers. When one or more sets of scrolls are normally completed, an interrupt is generated to the CPU 1 so as to notify that the scrolling is normally finished (S9).

The scrolling operation of the GDC apparatus in the embodiment will be described concretely as follows. FIG. 7 shows the relationship between the display area from which display information of one screen is read out and a picture drawn according to display information in a data-stored area actually storing the display information in the frame memory 2. The name of each register is abbreviated for simplicity:

In this embodiment one byte is allotted to display information of one pixel, and the amount of scrolling is set by the number of pixels from the original prescribed (pre-scroll) position to the desired (post-scroll) position. The scrolling frequency is represented in a unit of one display cycle. Supposing that the number of pixels per scanning line of the CRT 4 is X1, namely, WR=X1, and the number of bits per pixel is 8 bits, namely, PR=8, (1) in the state of FIG. 7A, it is so set that:

DB=1, DB2 to DBn=0

CR1=10, CR2 to CRn=0

FR1=1, FR2 to FRn=0

When SS has a value other than zero set therein, the GDC apparatus starts to scroll. The display area is moved every one pixel per display cycle to the right, and the figure is scrolled to the left pixel by pixel. When the figure is scrolled by 10 pixels to the left, the scrolling is finished (FIG. 7B).

Figure 7A:
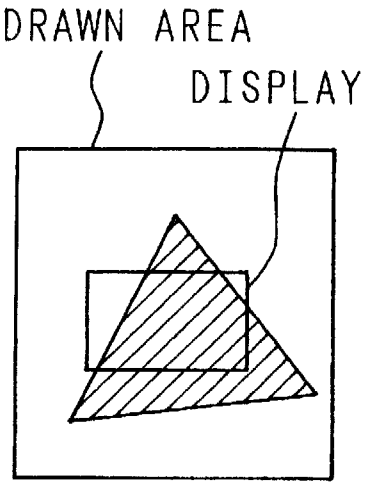
FIGS. 7A to 7H are conceptual diagrams each showing the relationship between a figure to be drawn in accordance with display information of a data-stored area of the frame memory and the display area of one screen at the time of scrolling.
Figure 7B:
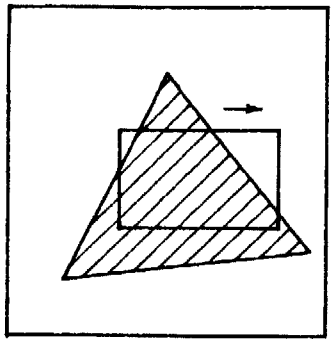
Figure 7C:
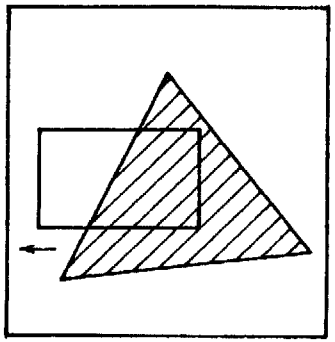

(2) in the state of FIG. 7A, if registers other than DB1 are set at the same values as in (1) while DB1=−1, the figure is scrolled to the right by 10 pixels, and the scrolling is finished (FIG. 7C).

Figure 7D:
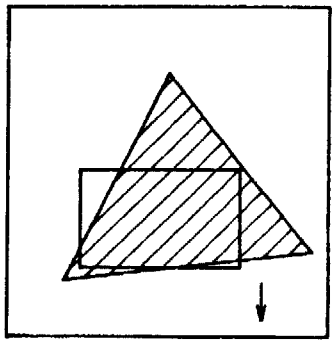

(3) in the state of FIG. 7A, if registers other than DB1 are set at the same values as in (1) while DB1=X1, the figure is scrolled by 10 pixels upward, and the scrolling is finished (FIG. 7D).

Figure 7E:
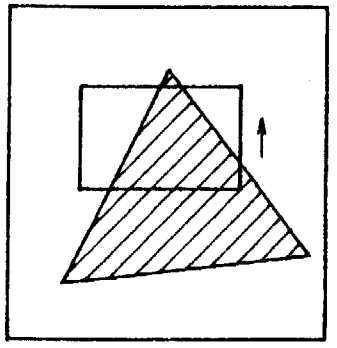

(4) in the state of FIG. 7A, if registers other than DB1 are set at the same values as in (1) while DB1=−X1, the figure is scrolled downward by 10 pixels, and the scrolling is finished (FIG. 7E).

Figure 7F:
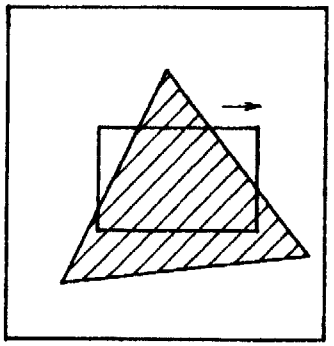

(5) in the state of FIG. 7A, if, after the registers are set at the same values as in (1), SS is set to be zero before the scrolling is finished, the scrolling is interrupted. If the CR1 shows 5 at the interruption time, it means that the scrolling is stopped with the figure scrolled to the left by 5 pixels from the original position (FIG. 7F).

The value of CR1 at the time of interruption can be read out in a prescribed procedure, allowing a software controlling the scrolling to be easily informed of the number of scrolls executed up to the interruption.

(6) in the state of FIG. 7A, if registers other than FR1 are set at the same values as in (1) while FR1 is 5, the display area is shifted to the right every one pixel per 5 display cycles, and the figure is scrolled to the left. Finally, when the figure is scrolled to the left by 10 pixels, the scrolling is finished (FIG. 7B). The scrolling speed is one-fifth times as slow as in the case of (1) above.

(7) in the state of FIG. 7A, it is so set that:

DB1=1, DB2=−X1, DB3 to DBn=0

CR1=10, CR2=20, CR3 to CRn=0

FR1=1, FR2=5, FR3 to FRn=0

Figure 7G:
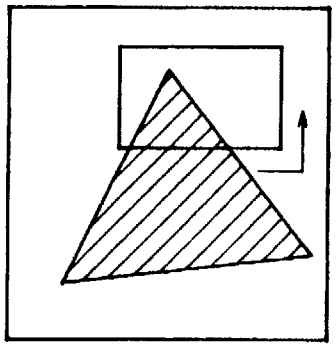

In this case, the display area is shifted to the right pixel by pixel per display cycle. After the display area is shifted 10 pixels in total, then the display area is shifted upward pixel by pixel per 5 display cycles until the display area is shifted 20 pixels, and the scrolling is stopped. That is, the figure is scrolled to the left by 10 pixels (FIG. 7B), and then scrolled downward by 20 pixels at one-fifth times of the initial speed (FIG. 7G).

(8) in the state of FIG. 7A, it is so set that:

DB1=(X1−1), DB2 to DBn=0

CR1=10, CR2 to CRn=0

FR1=1, FR2 to FRn=0

Figure 7H:
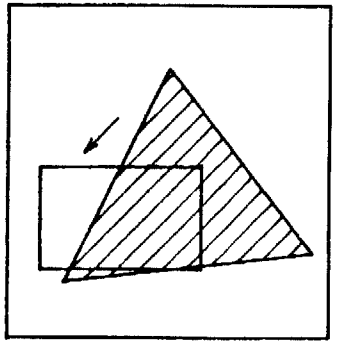

In this case, since the display area is shifted to the left and downward each by one pixel per display cycle, the figure is scrolled to the right and upward each by one pixel per display cycle. In this way, when the figure is scrolled diagonally to the right and upward each by 10 pixels, the scrolling is stopped (FIG. 7H).

Embodiment 2

Figure 8:
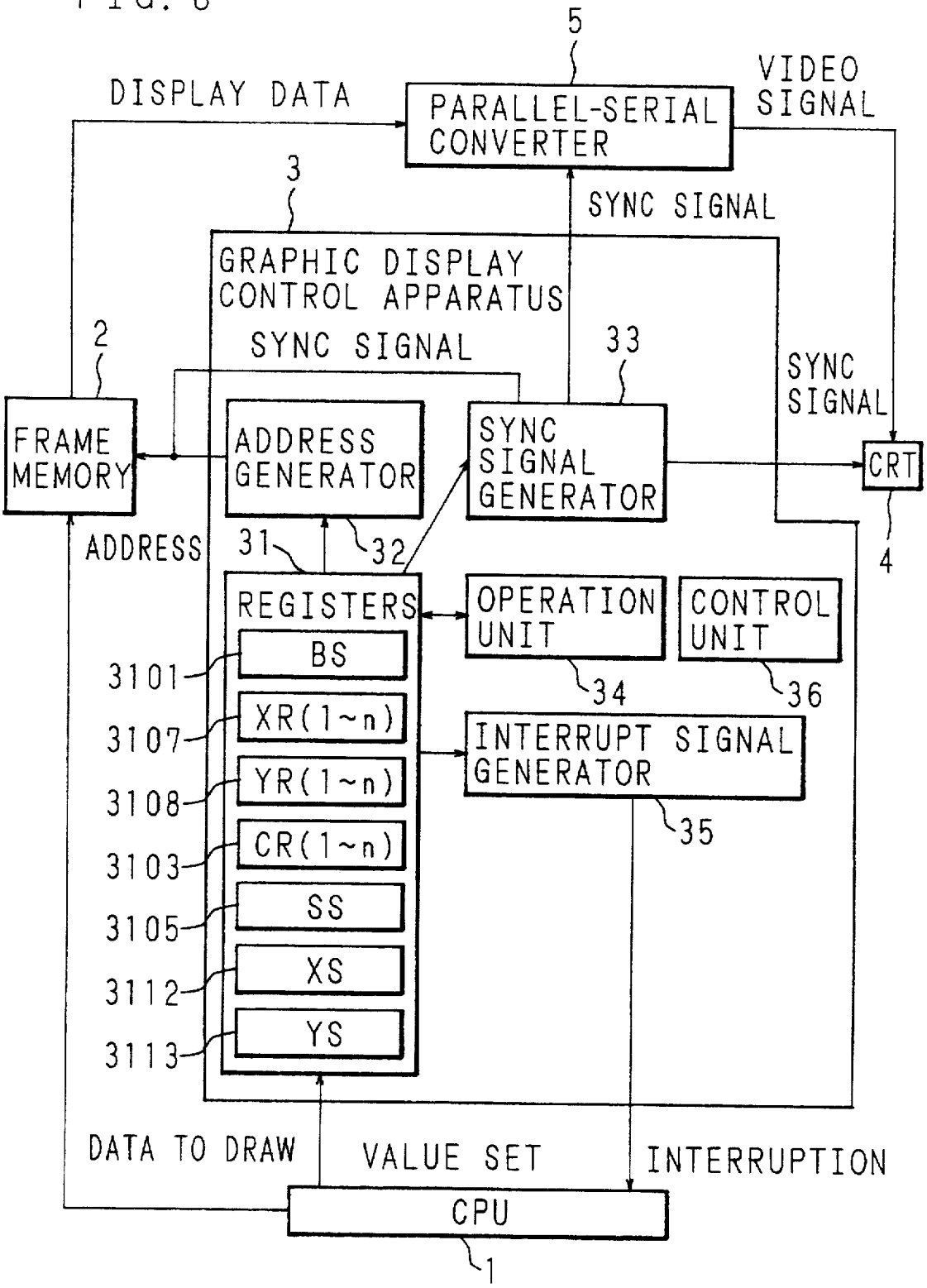
FIG. 8 is a structural block diagram showing a second embodiment of a GDC apparatus embodying the present invention which is incorporated in a computer system.

FIG. 8 is a block diagram showing the structure of a computer system having a GDC apparatus in a different embodiment incorporated therein. The same or corresponding parts as in the embodiment of FIG. 4 are denoted by the same reference numerals and symbols, and the description will be omitted here. In the second embodiment, instead of the scroll-amount register DB3102 setting the amount of scrolling by the number of pixels or addresses, the amount of scrolling is set by X and Y coordinates values when the screen of the CRT4 is represented by X and Y coordinates, and (n) sets of registers XR3107 and YR3108 are used. The register XR3107 stores the amount of scrolling in the X-axis direction, and the register YR3108 stores the amount of scrolling in the Y-axis direction. In addition, registers XS3112 and YS3113 are provided for storing accumulated amounts of scrolling in the X-axis direction and in the Y-axis direction, respectively.

The second embodiment is not provided with the scroll-frequency register FR, and the scrolling frequency is fixed per display cycle. However, it is possible to provide one or more scroll-frequency registers FR as in the first embodiment, whereby an optimal scrolling frequency or frequencies may be set.

In FIG. 8 the scroll-end notice register EN is omitted for simplicity.

The scrolling operation of the GDC apparatus of the second embodiment will be described.

(1) In the state of FIG. 7A, registers are set as follows:

XR1=−1, XR2 to XRn=0

YR1 to YRn=0

CR1=10, CR2 to CRn=0

If SS has a value other than zero set therein, the GC apparatus starts to scroll. The display area is moved pixel by pixel to the right per display cycle, and the figure is scrolled to the left pixel by pixel (in the negative direction along the X-axis). When the figure is scrolled by 10 pixels is the negative direction of the X-axis, the scrolling is finished (FIG. 7B).

(2) in the state of FIG. 7A, if the same values as those in (1) are set in registers other than XR1 while XR=1, the figure is scrolled to the right (in the positive direction along the X-axis) by 10 pixels, when the scrolling is finished (FIG. 7C).

(3) in the state of FIG. 7A, if XR1=0, YR1=1 and other registers are set at the same values as in (1), the figure is scrolled upward by 10 pixels (in the positive direction along the Y-axis), and the scrolling is finished (FIG. 7D).

(4) in the state of FIG. 7A, if XR1=0 and YR1=−1 and other registers are set at the same values as in (1), the figure is scrolled downward (in the negative direction along the Y-axis) by 10 pixels, and the scrolling is finished (FIG. 7E).

(5) in the state of FIG. 7A, if, after the same values as those in (1) are set in registers, zero is set at SS before the scrolling is finished, the scrolling is interrupted. If XS is −5 and YS is 0 at the time of the interruption, it means that the scrolling is stopped with the figure scrolled by 5 pixels from the original position in the negative direction along the X-axis (FIG. 7F).

(6) in the state of FIG. 7A it is so set that:

XR1=−1, XR2 to XRn=0

YR1=0, YR2=−1, YR3 to YRn=0

CR1=10, CR2=20, CR3 to CRn=0

In this case, the display area is shifted to the right (in the positive direction of the X-axis) pixel by pixel per display cycle, totally by 10 pixels, and then the display area is shifted upward (in the positive direction of the Y-axis) pixel by pixel per display cycle, 20 pixels in total. That is, the figure is scrolled to the left (in the negative direction of the X-axis) by 10 pixels (FIG. 7B), and then scrolled downward (in the negative direction of the Y-axis) pixel by pixel (FIG. 7G).

(7) in the state of FIG. 7A, it is so set that:

XR1=1, XR2 to XRn=0

YR1=1, YR2 to YRn=0

CR1=10, CR2 to CRn=0

In this case, after the figure is scrolled diagonally between the positive direction of the X-axis and the positive direction of the Y-axis pixel by pixel per display cycle, the figure is eventually scrolled diagonally between the positive direction of the X-axis and the positive direction of the Y-axis each by 10 pixels, when the scrolling is finished (FIG. 7H).

In this way, Embodiment 2 enables the amount of scrolling to be set by X and Y coordinates. When, for example, this embodiment is applied to software designed to control the scrolling operation, it provides a user interface allowing the user to grasp the amount of scrolling intuitively.

Embodiment 3

Figure 9:
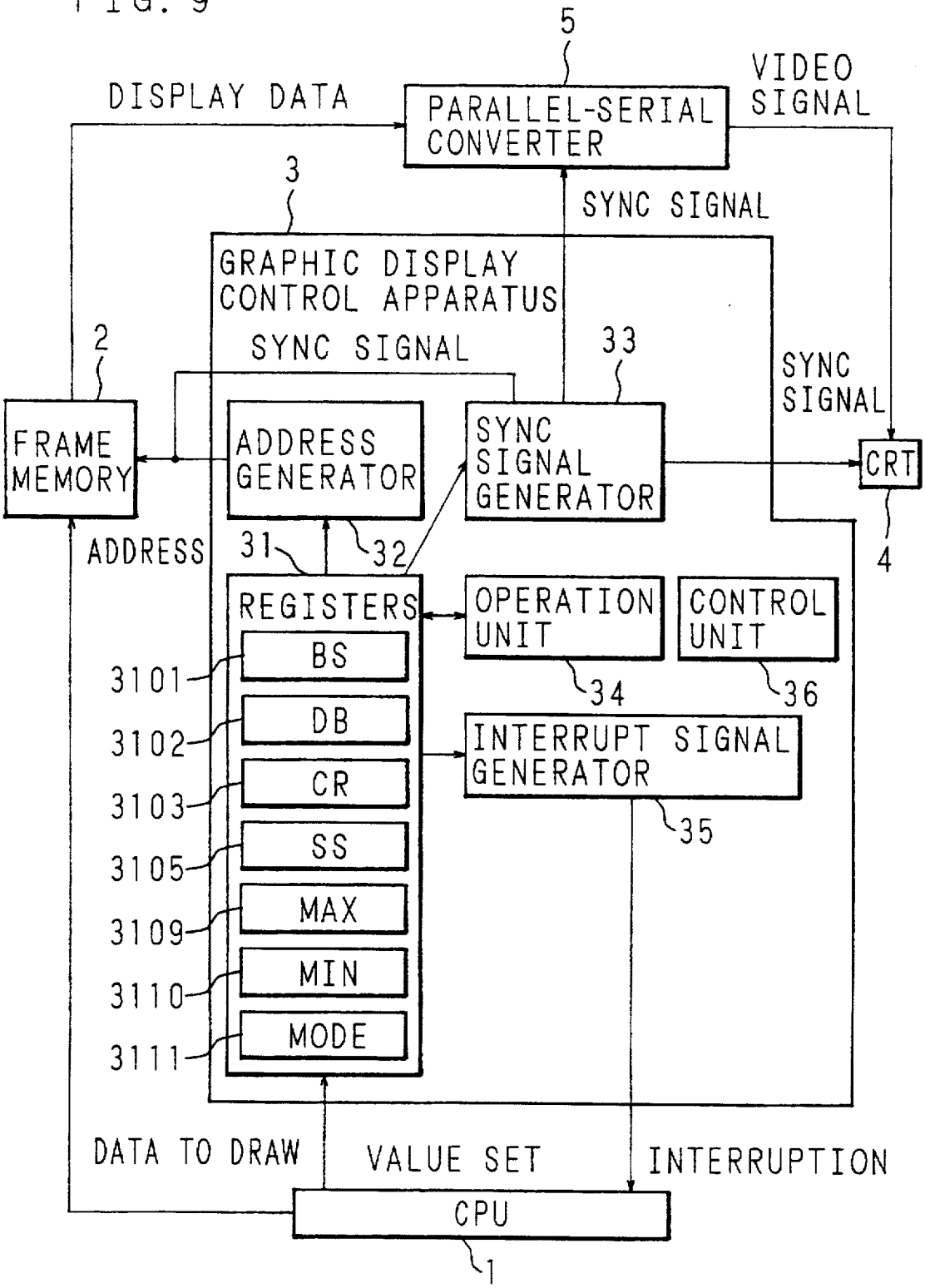
FIG. 9 is a structural block diagram showing a third embodiment of a GDC apparatus embodying the present invention which is incorporated in a computer system.

FIG. 9 is a block diagram showing the configuration of a computer system having a GDC apparatus in a yet different embodiment of the invention incorporated therein. The same or corresponding parts as in FIG. 4 are denoted by the same reference numerals and symbols, and the description will be omitted here.

In addition to the registers used in Embodiment 1, three registers MAX3109, MIN3110 and MODE3111 are provided. The registers MAX31O9 and MIN3110 respectively store a maximum value and a minimum value of the address to be set in the display address register BS3101, namely, of the address of the display area where the whole display information can be read out. The mode register MODE3111 stores a mode value of scrolls which is described as follows.

When zero is set to the mode register MODE3111, the value set in each of the registers MAX3109 and MIN3110 has no meaning. When one is set to the mode register MODE3111, if the value of the display address register BS3101 either exceeds the value set in the register MAX3109 or becomes smaller than the value set in the register MIN3110 as a result of scrolling in accordance with the set amount and the set number of scrolls, an interrupt is generated to the CPU 1 at the start of scrolling thereby to notify the erroneous setting (advance notice mode). When two is set in the mode register MODE3111, if the value set in the display address register BS3010 exceeds the value set in the register MAX3109 or becomes smaller than the set value in the register MIN3110 in the course of scrolls in accordance with the set amount and the set number of scrolls, an interrupt is generated to the CPU 1 to notify to write display data about an image to be displayed subsequently (in-process notice mode).

The third embodiment is not provided with the scroll-frequency register FR, and the scrolling frequency is fixed per display cycle. However, it is possible to provide one or more scroll-frequency registers FR as in the first embodiment, whereby an optimal scrolling frequency or frequencies may be set.

The scroll-end notice register EN is not shown for simplicity in the present embodiment.

As in Embodiment 1, a plurality of sets of scroll-amount registers DB3102 and scroll-times registers CR3103 may be provided in the apparatus.

The operation of this embodiment in each mode will be described below.

(1) Advance Notice Mode

FIGS. 10A to 10D are conceptual diagrams of the relationship between the frame memory and the display area of one screen at the scrolling time in the advance notice mode, in which MODE=1 is set in the mode register. In the embodiment, it is supposed that the display area has a size of x0 pixels (X-axis)×y0 pixels (Y-axis), and the frame memory has a size corresponding to x1 pixels (X-axis)×y1 pixels (Y-axis), and that the frame memory expands from A0 to A1 in address space (excluding A1: A1=A0+x1×y1), when a representative address specifying a particular display area is the one of the pixel located at the upper left corner of the display area of the CRT4, i.e., the upper left address. Moreover, in the following example, it is supposed that MIN=A0(FIG. 10B), MAX=A1−(y0×x1) (FIG. 10C) are set.

Figure 10A:
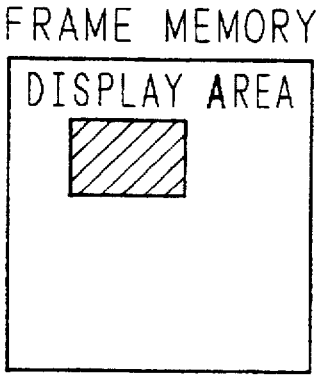
FIGS. 10A to 10D are conceptual diagrams each showing the relationship between the frame memory and the display area of one screen at the time of scrolling in an advance notice mode in the GDC apparatus of the third embodiment.
Figure 10B:
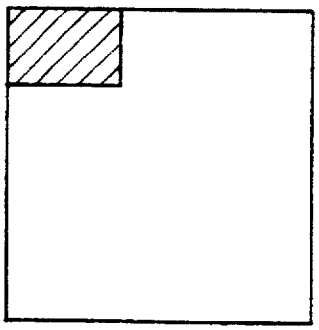
Figure 10C:
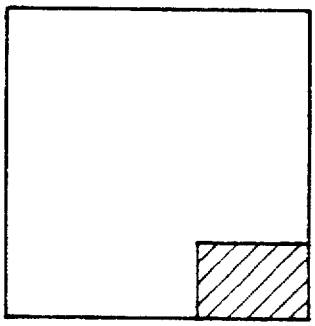
Figure 10D:
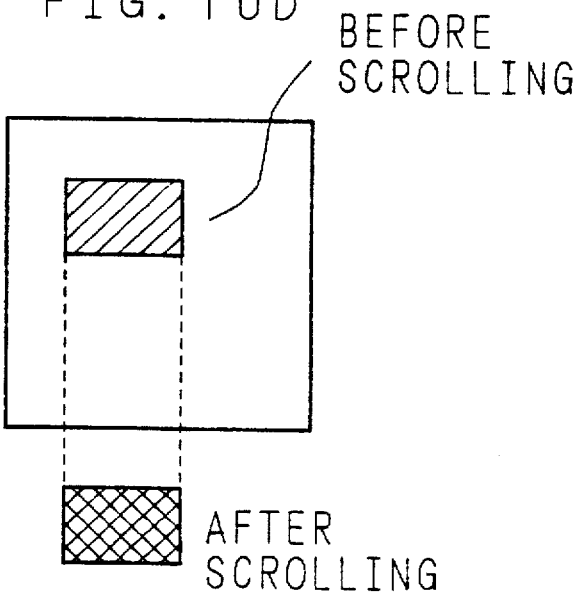

If DB=x1 and CR=y1 are set in the state of FIG. 10A, the display area will be moved to a position shown in FIG. 10D. Since the value of BS at this position exceeds the value set at MAX, an interrupt is generated to the CPU 1 to notify the CPU 1 of the erroneous setting when the value except zero is set to the scroll-start register SS3105, and no scrolls are executed.

The function of notifying an erroneous setting prior to starting of the scrolling can be useful in that it provides friendly user interface in development of software designed for controlling scroll.

(2) In-Process Notice Mode

FIGS. 11A to 11E are conceptual diagrams of the relationship between the frame memory and the display area for one screen and re-writing of display information of the frame memory at the time of scrolling in the in-process notice mode, in which MODE=2 is set in the mode register. This mode is utilized when the second image is continuously displayed after the first image whose display information has been written in the frame memory 2.

Figure 11A:
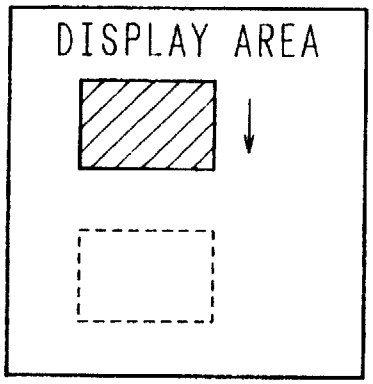
FIGS. 11A to 11E are conceptual diagrams each showing the relationship between the frame memory and the display area of one screen at the time of scrolling and rewriting of the display information of the frame memory in an in-process notice mode in the GDC apparatus of the third embodiment.
Figure 11B:
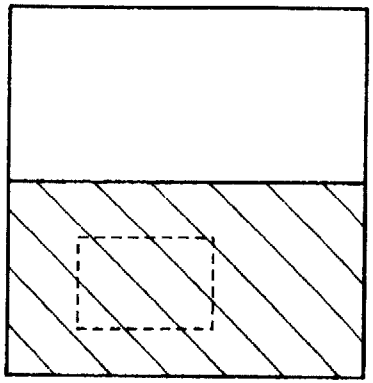
Figure 11C:
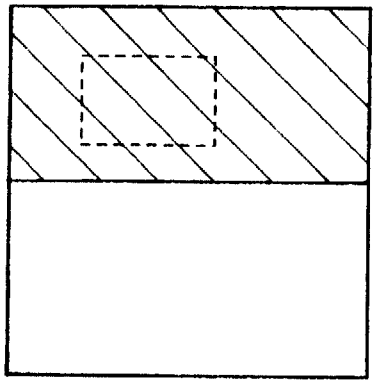

In the state of FIG. 11A, it is so set that:

DB=x1

CR=y1

MAX: the address of the upper left corner in the display area indicated by a broken line in FIG. 11A. The position indicated by this broken line is so determined that, as a result of scrolling, the display area comes near to the boundary of the frame memory and the subsequent scrolling soon becomes unnecessary and, at the same time, the area has a wide space around it sufficient to write the display contents of the second image after the copying explained below, and moreover there is enough amount of scrolling left that copying the display content of the first image and updating the display addresses, etc. under the control of the CPU 1, which will be discussed below can be executed.

After the values mentioned above are set and the scrolling is started, every time when the display area reaches the position indicated by the broken line in FIG. 11A through scrolling, the operation unit 34 compares the value in the display address register BS3101 and that in the register MAX3109 in order to find out the value in the display address register BS3101 exceeds that in the register MAX3109. When this condition is satisfied, the interrupt signal generator 35 generates an interrupt to the CPU 1. Synchronizing with the interrupt signal, the CPU 1 starts to copy the contents of an area indicated by oblique lines in FIG. 11B including the displayed area (the lower half portion of the frame memory 2 in the direction in which the display area is moved via scrolling) which is not displayed through a subsequent scrolling to an area shown in FIG. 11C, and it rewrites the value in the display address register BS3101 to an address of the copied new area, and again it sets other registers for automatic scrolling. Then the GDC apparatus 3 resumes scrolling. Thereafter, the CPU 1 writes display information about a figure subsequently displayed through scrolling in the upper half blank area in FIG. 11C. In this way, figures beyond the capacity of the frame memory 2 are displayed through automatic scrolling.

Figure 11D:
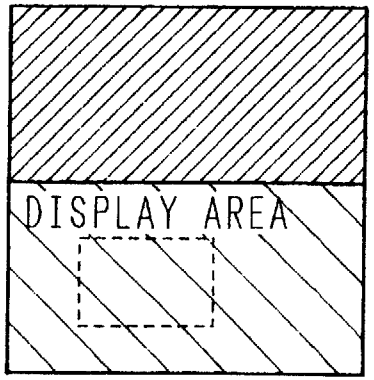
Figure 11E:
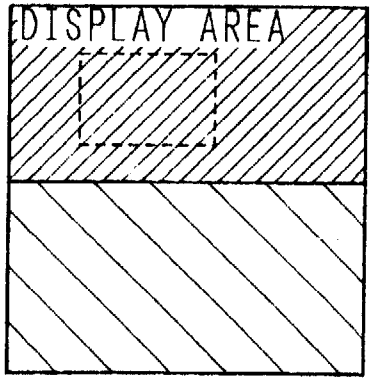

During the series of scrollings, if a need arises for shifting the display of the first image to that of the second one discontinuous from the first one, the display information about the second image is written in the upper half part of the frame memory 2 where display information unnecessary for the subsequent scrolling is written (FIG. 11D). This case is in contrast to the one referred to above, in which the content of the area including the on-display area is copied to the upper half part of the frame memory 2. In this case, the address when the display area reaches the boundary at the lowest end of the frame memory 2 is set in the MAX3109, and when the display area really reaches the frame memory 2, i.e., when the comparison shows that the value in the display address register BS3101 is equal to or greater than the value in the register MAX3109, the value in the display address register BS3101 is rewritten to a starting address of scroll of the second image written in the upper half of the frame memory 2.

Throughout Embodiments 1 to 3, the amount of scrolling is set by the number of pixels or X- and Y-coordinates, but it can be set by address data corresponding to the address for the frame memory 2. Herein, for example, if eight bits are allotted to one pixel, address data in byte is stored as the amount of scrolling. When four bits are allotted to one pixel, address data with an additional bit to indicate whether the four bits are located in the higher or lower half in a byte is stored as the amount of scrolling. If two bits are allotted to one pixel, address data with two additional bits to indicate which set of the two bits in a byte is stored as the amount of scrolling. If one bit is allotted to one pixel, address data with three additional bits to indicate which bit in a byte is stored as the amount of scrolling.

As this invention may be embodied in several forms without departing from the spirit of essential characteristics thereof, the present embodiments are therefore illustrative and not restrictive, sine the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A graphic display control apparatus for sequentially scrolling display contents of a screen by sequentially shifting read-out areas to read display information of one screen from a frame memory whose capacity allows a CPU to write larger display information than one screen therein and transferring display information at each read-out area to a display unit, the graphic control apparatus comprising:

an address storing means for storing a reading address specifying the read-out area at the starting time of scroll;

a scroll-amount storing means for storing the amount of one scroll;

a scroll-times storing means for storing the number of scrolls to be executed;

an operation means for updating the reading address stored in said address storing means by a value corresponding to the amount of one scroll;

an address generating means for generating an address of the frame memory from which display information is to be read out according to the reading address stored in said address storing means; and a counting means for counting the number of executed scrolls, wherein the display contents of the screen are scrolled horizontally, vertically or diagonally in accordance with the amount of scrolling.

2. The graphic display control apparatus according to claim 1, further comprising a means for generating an interrupt signal to the CPU when the prescribed number of scrolls are finished.

3. The graphic display control apparatus according to claim 1, further comprising a scroll-frequency storing means for storing a moving frequency of the read-out areas for display information so as to determine a scrolling speed.

4. The graphic display control apparatus according to claim 2, further comprising a scroll-frequency storing means for storing a moving frequency of the read-out areas for display information so as to determine a scrolling speed.

5. The graphic display control apparatus according to claim 1, wherein a plurality of scroll-amount storing means are provided.

6. The graphic display control apparatus according to claim 5, further comprising a plurality of scroll-frequency storing means.

7. The graphic display control apparatus according to claim 2, wherein a plurality of scroll-amount storing means are provided.

8. The graphic display control apparatus according to claim 7, further comprising a plurality of scroll-frequency storing means.

9. The graphic display control apparatus according to claim 3, wherein a plurality of scroll-amount storing means are provided.

10. The graphic display control apparatus according to claim 9, wherein a plurality of scroll-frequency storing means are provided.

11. The graphic display control apparatus according to claim 4, wherein a plurality of scroll-amount storing means are provided.

12. The graphic display control apparatus according to claim 11, wherein a plurality of scroll-frequency storing means are provided.

13. The graphic display control apparatus according to claim 1, wherein a plurality of scroll-times storing means are provided.

14. The graphic display control apparatus according to claim 13, further comprising a plurality of scroll-frequency storing means.

15. The graphic display control apparatus according to claim 2, wherein a plurality of scroll-times storing means are provided.

16. The graphic display control apparatus according to claim 15, further comprising a plurality of scroll-frequency storing means.

17. The graphic display control apparatus according to claim 3, wherein a plurality of scroll-times storing means are provided.

18. The graphic display control apparatus according to claim 17, wherein a plurality of scroll-frequency storing means are provided.

19. The graphic display control apparatus according to claim 4, wherein a plurality of scroll-times storing means are provided.

20. The graphic display control apparatus according to claim 19, wherein a plurality of scroll-frequency storing means are provided.

21. The graphic display control apparatus according to claim 5, wherein a plurality of scroll-times storing means are provided.

22. The graphic display control apparatus according to claim 21, further comprising a plurality of scroll-frequency storing means.

23. The graphic display control apparatus according to claim 7, wherein a plurality of scroll-times storing means are provided.

24. The graphic display control apparatus according to claim 23, further comprising a plurality of scroll-frequency storing means.

25. The graphic display control apparatus according to claim 1, further comprising:

a storing means for storing maximum and minimum values of reading addresses for the read-out areas wholly included in a memory space of the frame memory, a judging means for judging, prior to starting of scrolling, whether the reading address exceeds the maximum value or falls below the minimum value as a result of scrolling specified by the preset amount and the preset number of times; and means for notifying an error in the amount of scrolling in the scroll-amount storing means or in the executed number of times in the scroll-times storing means when the judging means shows that the reading address exceeds the maximum value or falls below the minimum value.

26. The graphic display control apparatus according to claim 1, further comprising:

means for storing a reading address for a read-out area at a prescribed location in an area of the frame memory in which display information about the first display content is written, thereby displaying, through scrolling, the second display content whose information is not written in the frame memory continuously to the first display content;

means for comparing the reading address stored in the address storing means with the reading address for the read-out area at the prescribed location;

means for setting conditions for comparison performed by the comparing means;

means for judging whether the result of comparison satisfies the conditions for the comparison; and means for generating an interrupt signal notifying the CPU to write the display information about the second display content into the frame memory.

27. The graphic display control apparatus according to claim 1, further comprising means for interrupting the scroll and means for outputting information representing the number of scrolls executed up to the interruption.

28. The graphic display control apparatus according to claim 1, further comprising means for interrupting the scroll and means for outputting information representing an integrated amount of scrolls executed up to the interruption.

* * * * *